US007887441B1

(12) United States Patent
Archer

(10) Patent No.: US 7,887,441 B1
(45) Date of Patent: Feb. 15, 2011

(54) T-BALL TRAINING SYSTEM

(76) Inventor: Stephen Archer, 6264 Audubon Dr., Milton, FL (US) 32570

( * ) Notice: Subject to any disclaimer, the term of this patent is extended or adjusted under 35 U.S.C. 154(b) by 0 days.

(21) Appl. No.: 12/586,267

(22) Filed: Sep. 21, 2009

(51) Int. Cl.
*A63B 69/00* (2006.01)

(52) U.S. Cl. ..... 473/417; 473/422; 473/451

(58) Field of Classification Search ..... 473/417, 473/422, 431, 451, 453, 284, 386, 387, 406
See application file for complete search history.

(56) References Cited

U.S. PATENT DOCUMENTS

| | | | | |
|---|---|---|---|---|
| 4,461,477 | A | 7/1984 | Stewart | |
| 4,834,376 | A | 5/1989 | Steinberg | |
| 5,380,001 | A * | 1/1995 | Socci et al. | 473/458 |
| 5,800,278 | A * | 9/1998 | Varriano | 473/209 |
| 6,146,289 | A * | 11/2000 | Miller et al. | 473/417 |
| 6,821,211 | B2 * | 11/2004 | Otten et al. | 473/219 |
| 7,169,067 | B2 | 1/2007 | Town | |
| 7,513,833 | B1 | 4/2009 | Town | |
| 2003/0104874 | A1 * | 6/2003 | Galanis et al. | 473/221 |
| 2006/0199670 | A1 | 9/2006 | Town | |

* cited by examiner

*Primary Examiner*—Mitra Aryanpour
(74) *Attorney, Agent, or Firm*—Peter Loffler

(57) ABSTRACT

A T-ball training system helps batters develop focus during ball hitting as well as timing skills and uses a tee that shines a light out of the top of the tee. A ball has a light tunnel therein that has a 90-degree bend, so that when the light shines out of the top, the light enters the tunnel at one end and is issued out of the other end, visible to the batter. The light is activated for a certain time interval such that the batter is expected to hit the ball whenever the light is on. The control system of the light can be either directly on the tee or can be assisted by a wireless transmitter. A second light can be provided that also issues light out of the top of the tee, this second light issuing a different color than the first and being on whenever the first light is off and being off whenever the first light is on.

19 Claims, 3 Drawing Sheets

T-BALL TRAINING SYSTEM

BACKGROUND OF THE INVENTION

1. Field of the Invention

The present invention relates to a T-ball training system that helps develop ball hitting focus and timing skills and more specifically to a device wherein the ball shines a light for a time interval during which time interval the ball is to be hit.

2. Background of the Prior Art

Baseball is the great American pastime watched by millions and played by millions more. Every Saturday during the spring baseball fields all across the country are filled with enthusiastic Little League players and the stands filled with cheering parents. Younger children, typically below the age of six years, also want to play baseball. However, such younger players typically lack the hand-eye coordination to be able to play the true game of baseball. For such players, the introductory game of T-ball is the first stop. In the game of T-ball, a ball, which is normally softer and lighter than a regular baseball, is statically placed atop a tee and a batter swings at the ball. When the ball is hit off of the tee, the normal rules of Little League, or some variation thereof, kick in. This allows batters to be able to develop swinging skills without the need to also have timing skills needed for a dynamic ball traveling across home plate.

However, many T-ball coaches want T-ball batters to begin developing focus skills to focus at the ball on the tee, in order to give such players a better transition into Little League. To develop such skills, the coach wants the batter to hit the ball off of the tee during a brief time interval, such as during a given 1.5 second interval. The problem then becomes of communicating to the batter when that time interval is occurring. Some coaches simply yell out the start of the time interval and expect the batter to hit during the interval. While simple, this method is not overly effective as the yell may startle the batter and cause the batter to loose focus or the batter may not truly appreciate the start signal as the yell is competing with the yelling crowd of parents on the sidelines. Additionally, this method gives poor feedback to the batter if he or she hits outside of the time interval. Some coaches turn on a flashlight during the interval and turn it off at the end of the interval so that the batter knows that if the light turns off before the ball is hit, the interval is missed. However, as the coach is some distance away from the tee and the ball thereon, the flashlight becomes a distraction to the player as the player must be watching the coach instead of the ball and the player's swing may suffer as a result.

What is needed is a system that helps a T-ball player develop rudimentary ball hitting skills by focusing on the ball, which system overcomes the above stated shortcoming currently associated with such development efforts. Specifically, such a system must allow the batter to be able to focus his or her attention firmly on the ball so as to not be distracted. Such a system must not startle the player or confuse the player. Ideally, such a system is of relatively simple design and construction so as to be readily affordable to a large portion of potential consumers of the system. Such a system should be easy to use and maintain.

SUMMARY OF THE INVENTION

The T-ball training system of the present invention addresses the aforementioned needs in the art by providing a system whereby a batter is trained to focus on the ball atop the tee. The T-ball training system does not startle the batter nor competes with crowd noise. The present invention gives the batter instant feedback if his or her focus is off. The T-ball timing system is of relatively simple design and construction, being produced using standard manufacturing techniques so as to be readily affordable for purchase. The T-ball timing system is easy to use and maintain.

The T-ball training system of the present invention is comprised of a T-ball tee that has an open top. A first light bulb is disposed within the tee and capable of issuing a first light beam of a first hue out of the open top. A control system is provided for turning the first light bulb on when desired for a finite time interval and thereafter turning the first light bulb off. A ball is receivable atop the open top such that the ball has a light tunnel passing therethrough and such that when the ball is received atop the open top and the first light bulb is illuminated, the first light beam issued by the first light bulb enters a first end of the light tunnel and exits a second end of the light tunnel. The light tunnel is a single filament large bore fiber optic line and has a 90-degree elbow shape. The control system comprises a control board that is electrically connected with the first light bulb and a transmitter that communicates with the control board. A battery provides electric power. The transmitter may be one or more control buttons located on the tee or may wirelessly communicates with the control board. The length of the time interval may be programmable. The ball may have a marking on an outer surface thereof, the marking encompassing the first end of the light tunnel in spaced apart fashion to the first end. A second light bulb may be disposed within the tee and be capable of issuing a second light beam of a second hue out of the open top such that when the second light bulb is illuminated, the second light beam issued by the second light bulb enters the first end of the light tunnel and exits the second end of the light tunnel and such that the second light bulb is illuminated whenever the first light bulb is not illuminated and the second light bulb is not illuminated whenever the first light bulb is illuminated. The first light bulb issues a green hue and the second light bulb issues a red hue.

BRIEF DESCRIPTION OF THE DRAWINGS

Similar reference numerals refer to similar parts throughout the several views of the drawings.

DESCRIPTION OF THE PREFERRED EMBODIMENT

Figure 1:
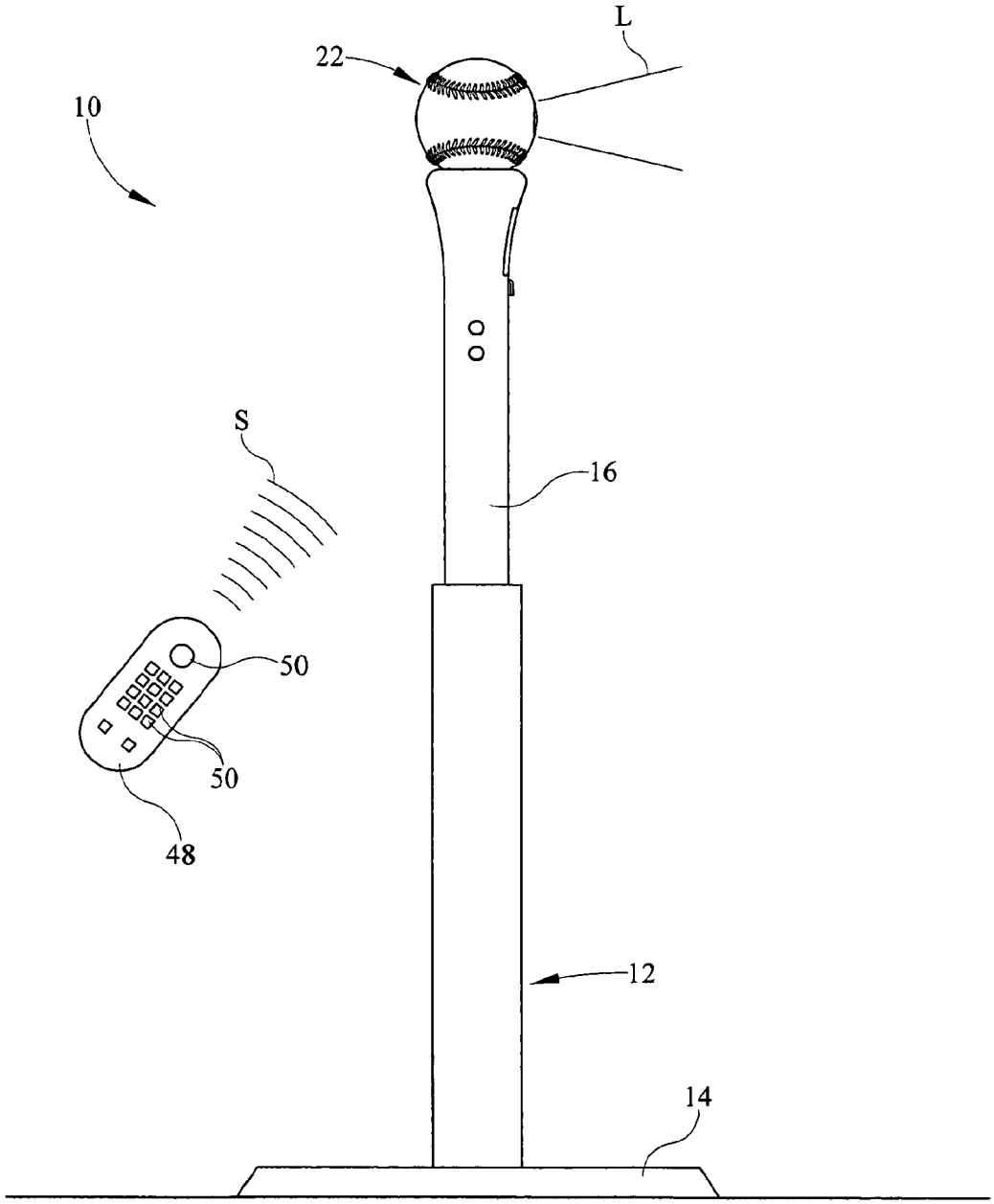
FIG. 1 is an environmental view of the T-ball training system of the present invention.
Figure 2:
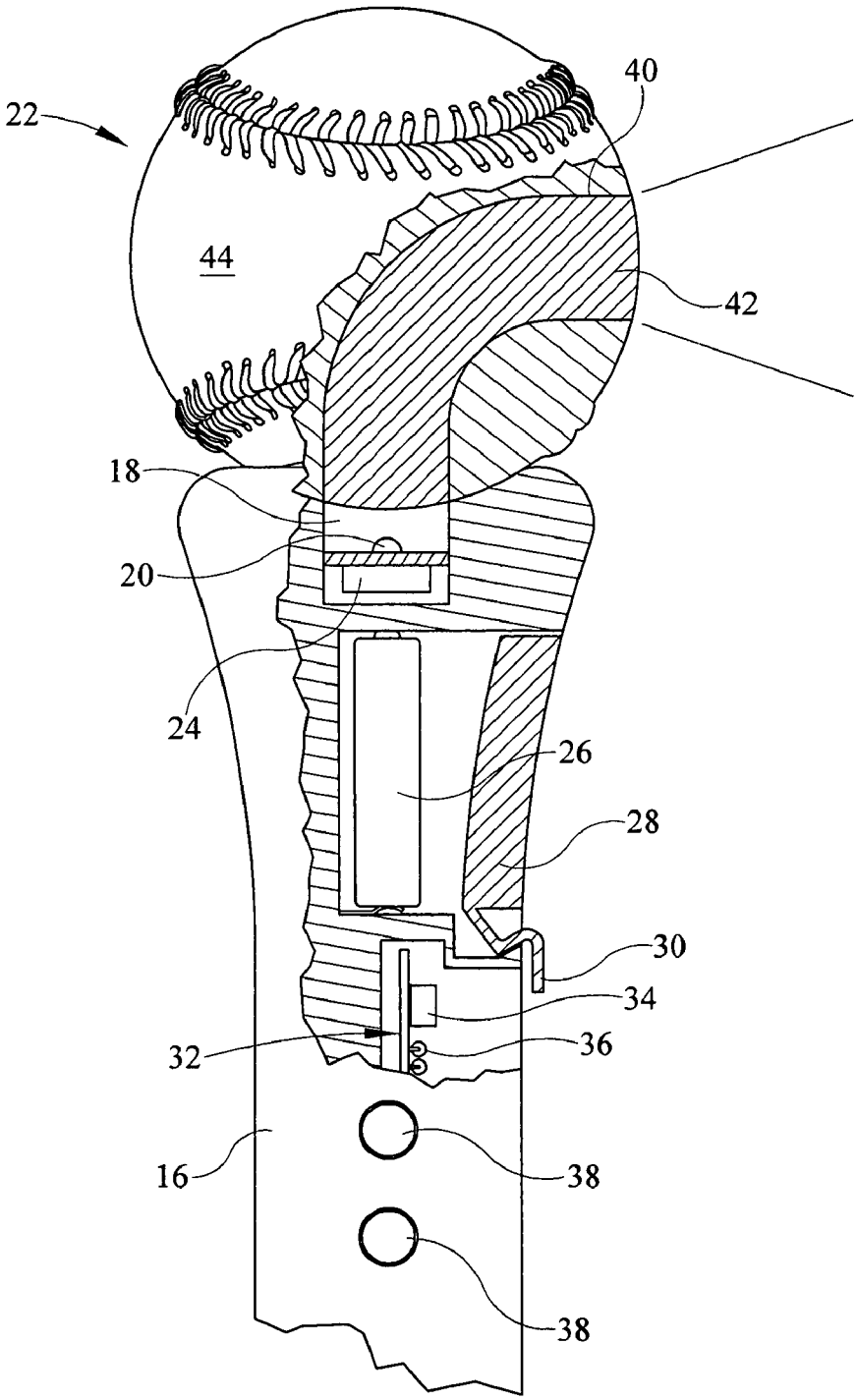
FIG. 2 is a side view, partially sectioned, of the T-ball training system.
Figure 3:
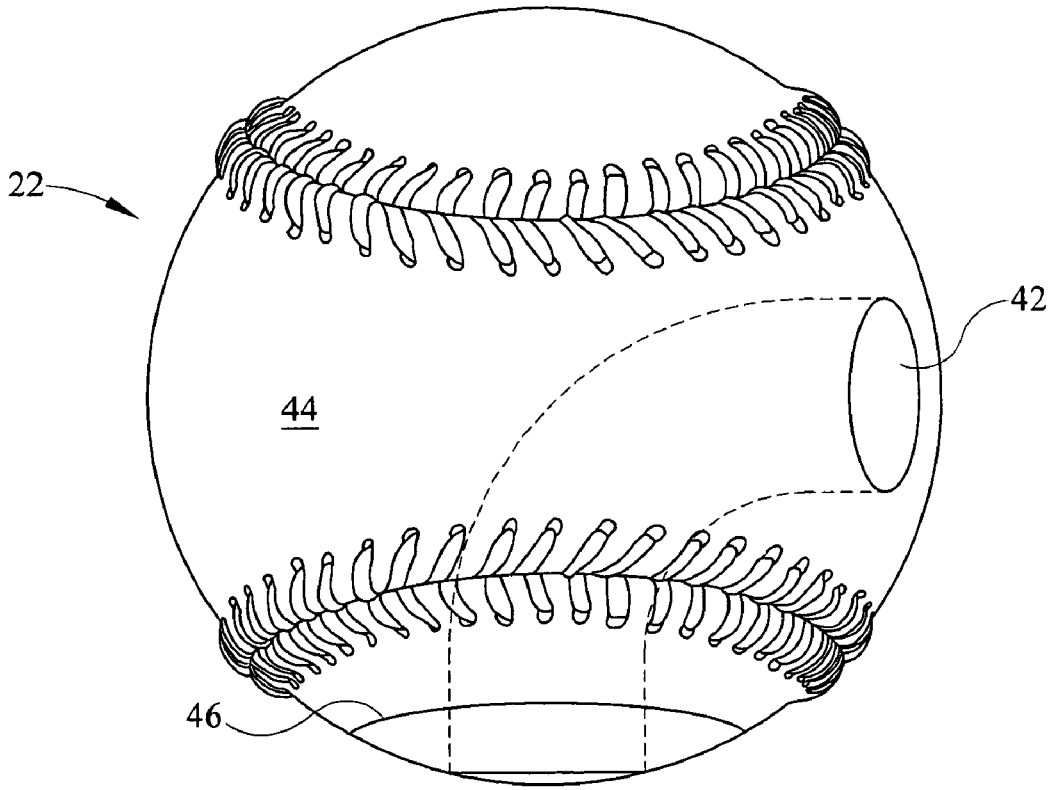
FIG. 3 is a close-up view of the ball used with the T-ball training system.

Referring now to the drawings, it is seen that the T-ball training system of the present invention, generally denoted by reference numeral 10, is comprised of a T-ball tee 12 which is a typical tee having a base 14 and an upwardly rising stanchion 16. The top of the stanchion 16 is open such that a hollow interior 18 exists immediately therebelow. The hollow interior 18 may be relatively narrow as shown or can be wider as needed and more fully explained below. At least one light bulb 20, preferably an LED, although other types of light bulbs can be used, is positioned within the hollow interior 18 and issues light upwardly toward the open top. I have found that a single LED bulb 20 works very satisfactory, however, the use of multiple LED bulbs 20 is more forgiving when the ball 22 is imperfectly seated on the top of the stanchion 16. The LED bulb 20 is threadably received within a heat sink 24.

A battery 26 is disposed within the stanchion 16 in order to provide a source of electric power for the LED 20. An access cover 28 with a latch 30 is located on the stanchion 16 for providing servicing access to the battery 26 (other service access schemes can also be employed instead of a cover such as having the stanchion 16 in two sections that threadably attach to one another, having the battery near the base 14, etc.—nevertheless, all control components including those discussed below are located sufficiently below the top so as to not be subject to frequent hits from a bat). A control board 32 is disposed within the stanchion 16 for controlling operation of the LED 20. The battery 26 is electrically connected to both the LED 20 and the control board 32 in typical fashion (the actual wiring not illustrated for brevity and clarity). The control board 32 has the needed circuitry thereon for operation of the LED 20 including a receiver 34 and a timer 36. One or more control buttons 38 are communicatively connected to the control board 32 for controlling the operation of the control board 32.

As seen, the ball 22, which is a typical ball used in the game of T-ball, has a hollow section 40 therein, which hollow section 40 is in the shape of a 90-degree elbow. Received within the hollow section 40 is a corresponding section of fiber optic line 42, which fiber optic line 42 terminates at either end of the hollow section 40 and is generally flush with the outer surface 44 of the ball 22 at each point of termination. The fiber optic line 42 is a single filament large bore plastic line. Located on the outer surface 44 of the ball 20, and encompassing one of the ends of the fiber optic line 42, is a generally circular marking 46 that corresponds to the outer circumference of the top of the stanchion 16.

A transmitter 48 is provided which transmitter 48 is in signal communication with the receiver 34 on the control board 32. The transmitter 48 has control buttons 50 thereon. The transmitter 48 has the usual components therein including a control board and a battery (none illustrated) as is typical for such transmitters 48. The transmitter 48 may also have a timer therein.

In order to use the T-ball training system 10 of the present invention and in its simplest form, the ball 22 is placed upon the top of the stanchion 16 so that one end of the fiber optic line 42 lines up with the LED 20. The marking 46 helps with proper ball 22 positioning. If multiple LEDs 20 are used, less precision in lining up the ball 22 is required. The other end of the fiber optic line 42 is pointed toward the batter. The subsystem within the stanchion 16 is turned on using one of the control buttons 38. Another control button 38 is depressed so that the LED 20 is illuminated (preferably after a short time interval to allow the coach to get out of the way), the time interval being controlled by the timer 36. The light L issued by the LED 20 goes up to and through the fiber optic line 42 and is dispatched out of the fiber optic line 42 so as to be visible to the batter. The LED 20 stays illuminated for a short time interval under control of the time 36, which can be factory preset or controlled by a user of the device. The batter is expected to hit the ball 22 during the time interval when the LED 20 is illuminated. If the batter has still not hit the ball 22 after the light L goes out, the batter knows that he or she missed the time interval during which the batter was expected to hit the ball 22. In this simplest form of the device 10, neither the transmitter 48 nor the receiver 34 are needed.

In a more robust version of the T-ball training system 10, the transmitter 48 is used so as to remove the coach from the tee 12 once the ball 22 is placed thereon. This more robust version works similar to the version just described, except that the transmitter 48 is used by the coach to control operation of the LED 20, the control buttons 38 on the stanchion being used mainly to turn the subsystem within the stanchion 16 on and off (or to duplicate at least some of the functions of the transmitter 48). Once the ball 22 is placed onto the stanchion 16, the coach uses the transmitter 48 to control operation of the LED 20. This can include the coach depressing the appropriate control button 50 on the transmitter 48 to turn the LED 20 on. The transmitter 48 issues a signal S that is received by the receiver 36 to turn the LED 20 on, which signal S is processed by the control board 32 and the LED 20 is illuminated. The timer 36 controls the time interval of LED 20 illumination and turns the LED 20 after the expiration of the time interval. Alternately, the control board 32 lacks the timer 36 such that a timer is located within the transmitter 48 so that when the control button 50 on the transmitter 48 is depressed, the turn LED 20 signal S is issued by the transmitter 48 and received by the receiver 34 and processed appropriately to turn the LED 20 on. Coincidentally, the timer within the transmitter 48 times the time interval and upon expiration of the time interval, the transmitter 48 issues a turn LED 20 off signal which is received by the receiver 34 and processed appropriately so as to turn the LED 20 off. The transmitter 48 can be used to program to control the length of the time interval using the control buttons 50 so that if the timer 36 is located on the control board 32, such programming is transmitted to the receiver 34 and processed appropriately. If the timer is located within the transmitter 40, the transmitter's control circuitry processes the time interval programming in the usual way.

Alternately, a control button 50 on the transmitter 48 is depressed to begin the time interval of LED 20 illumination such that the transmitter 48 sends out the illuminate LED 20 signal S to the receiver 34. The LED 20 stays illuminated only so long as the receiver 34 receives the illuminate LED 20 signal S. Therefore, the coach controls the length of the time interval by continuously depressing the control button 50 during which time the LED 20 is to be illuminated and undepressing the control button 50 when LED 20 illumination is no longer desired. When the receiver 34 no longer receives the signal S, the LED 20 is turned off.

As an alternative, at least two LEDs 20 can be located within the stanchion 16, each LED 20 of a different color, such as one LED 20 being red and the other LED 20 being green. In this embodiment, when the system 10 is activated, one of the LEDs 20 is immediately illuminated, say the red LED 20. When the time interval begins, this first LED 20 is turned off and the other LED 20, the green LED 20, is turned on. When the time interval expires, the second LED 20 is turned off and the first LED 20 is turned back on. In this way, the batter receives a red light green light type of signal for batting the ball.

While the invention has been particularly shown and described with reference to an embodiment thereof, it will be appreciated by those skilled in the art that various changes in form and detail may be made without departing from the spirit and scope of the invention.

I claim:

1. A training system comprising:

a T-ball tee having an open top;

a first light bulb disposed within the tee and capable of issuing a first light beam of a first hue out of the open top;

a control system for turning the first light bulb on when desired for a finite time interval and thereafter turning the first light bulb off; and a ball receivable atop the open top, such that the ball has a light tunnel passing therethrough such that when the ball is received atop the open top and the first light bulb is illuminated, the first light beam issued by the first light bulb enters a first end of the light tunnel and exits a second end of the light tunnel.

2. The training system as in claim 1 wherein the light tunnel is a single filament large bore fiber optic line.

3. The training system as in claim 2 wherein the light tunnel has a 90-degree elbow shape.

4. The training system as in claim 1 wherein the control system comprises:

a control board electrically connected with the light bulb; and a transmitter that communicates with the control board.

5. The training system as in claim 4 wherein the transmitter wirelessly communicates with the control board.

6. The training system as in claim 5 wherein the light tunnel is a single filament large bore fiber optic line.

7. The training system as in claim 6 wherein the light tunnel has a 90-degree elbow shape.

8. The training system as in claim 1 wherein the time interval is programmable.

9. The training system as in claim 1 wherein the ball has a marking on an outer surface thereof, the marking encompassing the first end of the light tunnel in spaced apart fashion to the first end.

10. The training system as in claim 1 further comprising a second light bulb disposed within the tee and capable of issuing a second light beam of a second hue out of the open top such that when the second light bulb is illuminated, the second light beam issued by the second light bulb enters the first end of the light tunnel and exits the second end of the light tunnel and such that the second light bulb is illuminated whenever the first light bulb is not illuminated and the second light bulb is not illuminated whenever the first light bulb is illuminated.

11. The training system as in claim 10 wherein the light tunnel is a single filament large bore fiber optic line.

12. The training system as in claim 11 wherein the light tunnel has a 90-degree elbow shape.

13. The training system as in claim 11 wherein the control system comprises:

a control board electrically connected with the light bulb; and a transmitter that communicates with the control board.

14. The training system as in claim 13 wherein the transmitter wirelessly communicates with the control board.

15. The training system as in claim 4 wherein the light tunnel is a single filament large bore fiber optic line.

16. The training system as in claim 15 wherein the light tunnel has a 90-degree elbow shape.

17. The training system as in claim 10 wherein the time interval is programmable.

18. The training system as in claim 10 wherein the ball has a marking on an outer surface thereof, the marking encompassing the first end of the light tunnel in spaced apart fashion to the first end.

19. The training system as in claim 10 wherein the first light bulb issues a green hue and the second light bulb issues a red hue.

* * * * *